US011788281B2

(12) United States Patent
Brants et al.

(10) Patent No.: US 11,788,281 B2
(45) Date of Patent: Oct. 17, 2023

(54) SUSPENDED ACOUSTIC SHELL ASSEMBLY WITH EMERGENCY FEATURE

(71) Applicant: Protech Theatrical Services, Inc., North Las Vegas, NV (US)

(72) Inventors: Will H Brants, Las Vegas, NV (US); Viet T Nguyen, North Las Vegas, NV (US)

(73) Assignee: Protech Theatrical Services, Inc., North Las Vegas, NV (US)

( * ) Notice: Subject to any disclaimer, the term of this patent is extended or adjusted under 35 U.S.C. 154(b) by 360 days.

(21) Appl. No.: 16/902,262

(22) Filed: Jun. 15, 2020

(65) Prior Publication Data

US 2021/0010260 A1 Jan. 14, 2021

Related U.S. Application Data

(60) Provisional application No. 62/861,518, filed on Jun. 14, 2019.

(51) Int. Cl.
*E04B 1/82* (2006.01)
*E04H 3/24* (2006.01)

(52) U.S. Cl.
CPC ..... *E04B 1/8236* (2013.01); *E04H 3/24* (2013.01)

(58) Field of Classification Search
CPC .... E04B 1/8236; E04B 1/8209; E04B 1/8218; E04B 1/8227; E04B 1/99; E04B 1/994; E04B 2001/8263; E04B 2001/8414; E04B 2001/8452; E04B 7/16; E04B 9/003; E04B 9/34; E04H 3/24; E04H 3/30
See application file for complete search history.

(56) References Cited

U.S. PATENT DOCUMENTS 3,590,354 A * 6/1971 Shiflet ..... E04B 1/994 318/245
3,828,507 A * 8/1974 Storer ..... E04B 9/30 52/764
4,926,599 A * 5/1990 Scholz ..... E04F 10/10 49/90.1
8,756,873 B1 * 6/2014 Hire ..... E04F 10/10 49/82.1
9,657,475 B1 * 5/2017 Steele ..... E04B 9/003
2006/0157297 A1 * 7/2006 D'Antonio ..... E04B 9/34 181/290
2008/0190690 A1 * 8/2008 Waters ..... E04B 1/994 181/287
2011/0028081 A1 * 2/2011 Hopkins ..... B23P 11/00 454/259
2013/0047541 A1 * 2/2013 Mayer ..... F21V 33/006 52/506.05

(Continued)

FOREIGN PATENT DOCUMENTS

EP 2096219 A1 * 9/2009 ..... E04B 1/8227

*Primary Examiner* — Kyle J. Walraed-Sullivan
(74) *Attorney, Agent, or Firm* — Newman Law, LLC

(57) ABSTRACT

An acoustic band shell assembly comprising a frame and one or more panels mounted to the frame for rotational motion between an open condition and a closed condition, the one or more panels forming a generally planar wall responsive to being engaged in the closed condition, wherein the one or more panels are biased for motion from the closed condition into the open condition responsive to being disengaged.

14 Claims, 7 Drawing Sheets

(56) References Cited

U.S. PATENT DOCUMENTS

| | | | | |
|---|---|---|---|---|
| 2013/0199736 | A1* | 8/2013 | Ro | E06B 7/086 160/7 |
| 2014/0353079 | A1* | 12/2014 | Gimpel | E04B 1/86 181/290 |
| 2015/0113883 | A1* | 4/2015 | Wang | G08B 3/10 52/741.1 |
| 2015/0376901 | A1* | 12/2015 | Partridge | E04B 9/001 52/64 |
| 2017/0121966 | A1* | 5/2017 | Jiang | E04B 9/003 |
| 2017/0198474 | A1* | 7/2017 | Graves | E04B 1/994 |
| 2017/0298623 | A1* | 10/2017 | Bierman | E04B 1/344 |
| 2019/0292774 | A1* | 9/2019 | Durali | E04B 1/994 |
| 2019/0323232 | A1* | 10/2019 | Mitchell | E04B 7/163 |
| 2019/0386606 | A1* | 12/2019 | Raghunathan | H02S 20/26 |

* cited by examiner

SUSPENDED ACOUSTIC SHELL ASSEMBLY WITH EMERGENCY FEATURE

FIELD OF THE INVENTION

The invention is directed to the field of acoustic shells, and more specifically, to moveable acoustic shells that are configured and designed for improved operability and compatibility with emergency systems.

BACKGROUND OF THE INVENTION

Acoustic shells are physical structures designed to capture sound produced in a performance area of a performance arts venue and to project the sound into an audience area of the venue. Many indoor performance settings, such as, for example, concert halls, auditorium or gymnasiums, the acoustics are less than ideal. In such indoor performance settings, an acoustical shell can help overcome the acoustical shortcomings of the performance area by keeping the sound from being lost to the sound-absorbing regions above the performance area, thereby allowing the performers to hear themselves better so that they can project a better blended sound to the audience. Acoustic shells are therefore found in a wide variety of performing arts venues, such as for example, school auditoriums, concert halls, theater houses and outdoor stages.

The acoustic shell encloses portions of the performance area with a back wall, side walls, and a canopy (above the performance area). Such an acoustic shell acts in some ways like a megaphone or bull horn, with sound produced at the narrow end of the megaphone (the rear of the acoustic shell) and emitted towards the audience at the wider of the megaphone (the wider front of the shell). In addition to outward sound projection, acoustical shells enable the individual performers to hear themselves and those around them so that they can make any necessary adjustments for intonation purposes without having to force their volume output in order to be heard.

Since venues are often designed to host a variety of different performances, some requiring an acoustic shell and some not, many venues use removable or movable acoustic shells. For instance, large auditorium style venues are commonly used to host both orchestra concerts, which generally require an acoustic shell, and theatrical productions, which generally do not. Accordingly, auditorium style venues typically provide removable acoustic shells to facilitate both types of performances.

Removable acoustic shells are conventionally formed by combining a collection of independent components within the stage area of a performing arts venue. For instance, the walls of a conventional removable acoustic shell may be formed by placing a number of panel sections side by side on the stage, while the ceiling of the conventional removable acoustic shell is formed by hanging panel sections from the stage rigging.

Unfortunately, these conventional removable acoustic shells have several shortcomings. These shells are generally cumbersome and require a significant amount of time and labor to set up and take down, which can prevent the stage from being usefully employed for rehearsals or additional performances. More critically, these shells were designed with portability and acoustics in mind, and are not designed to also consider emergency situations and the need to work with existing emergency systems, such as sprinkler systems. Indeed, even more troubling is that conventional acoustic shells would likely impede or completely block such systems by preventing water flow underneath, and may collect water which creates an additional hazard.

Accordingly, there is a need in the art for acoustic shells which can perform the functions needed of an acoustic shell while also ensuring the operability of existing emergency systems and the safety of the performers and members of the audience.

SUMMARY OF THE INVENTION

The invention is generally directed to systems which resolve the issues cited above as well as others in the art.

In some embodiments, the invention includes an acoustic shell assembly comprising a frame, one or more panels mounted to the frame for rotational motion between an open condition and a closed condition, the one or more panels being engaged in the closed condition to form a generally planar wall and disengaged in the open condition whereby the one or more panels are transverse with respect to the frame, wherein the one or more panels are biased for motion from the closed condition into the open condition responsive to disengagement.

In some embodiments, the one or more panels in the open condition are generally parallel with respect to adjacent one or more panels.

In some embodiments, the frame further comprises one or more beams, the one or more panels being mounted on the one or more beams for rotational motion between the open and closed conditions.

Some embodiments of the invention are directed to an acoustic band shell assembly comprising: a frame; one or more panels mounted to the frame for rotational motion between an open condition and a closed condition, the one or more panels forming a generally planar wall responsive to being engaged in the closed condition, wherein the one or more panels are biased for motion from the closed condition into the open condition responsive to being disengaged.

In some embodiments, the frame further includes at least one set of lateral beams.

In some embodiments, the one or more panels are mounted to the set of lateral beams.

In some embodiments, the one or more panels are mounted to the set of lateral beams by a rod extending from opposing lateral sides of each panel of the one or more panels.

In some embodiments, the rod is positioned to be offset from the center of gravity of the each panel to define a first panel portion adjacent to the rod having greater weight as compared with the second panel portion.

In some embodiments, at least two panels of the one or more panels are configured to form a non-permanent engagement with one another to maintain the at least two panels in the closed condition.

Some embodiments of the invention are directed to an acoustic band shell assembly comprising: first and second beam members, the first and second beam members being laterally space from one another to define a space between the first and second beam members; first and second panels mounted within the space between the first and second beam members, the first and second panels being mounted to the first and second beam members for rotational motion between an open condition and a closed condition, the first and second panels each including cooperating engagement members for forming an engagement to maintain the first and second panels in a generally planar configuration in the closed condition, wherein the first and second panels are biased for motion from the closed condition into the open condition responsive to being disengaged, the first and second panels being in a non-planar configuration in the open condition.

In some embodiments, the assembly further includes a support arm connected to the first and second beam members for suspending the assembly.

In some embodiments, the first and second beam members are arcuate.

In some embodiments, the first and second panels are rectangular shaped.

In some embodiments, the first and second panels are arcuate.

In some embodiments, the first and second panels are mounted to the first and second beam members by a rod extending from opposing lateral sides of each of the first and second panels.

In some embodiments, the rod is positioned to be offset from the center of gravity of the each panel to define a first panel portion adjacent to the rod having greater weight as compared with the second panel portion.

In some embodiments, the cooperating engagement members are in communication with electrical current to form an electromagnetic engagement.

BRIEF DESCRIPTION OF THE DRAWINGS

While the disclosure concludes with claims particularly pointing out and distinctly claiming specific embodiments, various features and advantages of embodiments within the scope of this disclosure may be more readily ascertained from the following description when read in conjunction with the accompanying drawings, in which:

DETAILED DESCRIPTION OF EMBODIMENTS OF THE INVENTION

It should understood that the invention is generally directed to systems, methods and apparatus for providing and operating an acoustic band shell assembly within or outside of a building structure which may have fire and other emergency systems.

Figure 1:
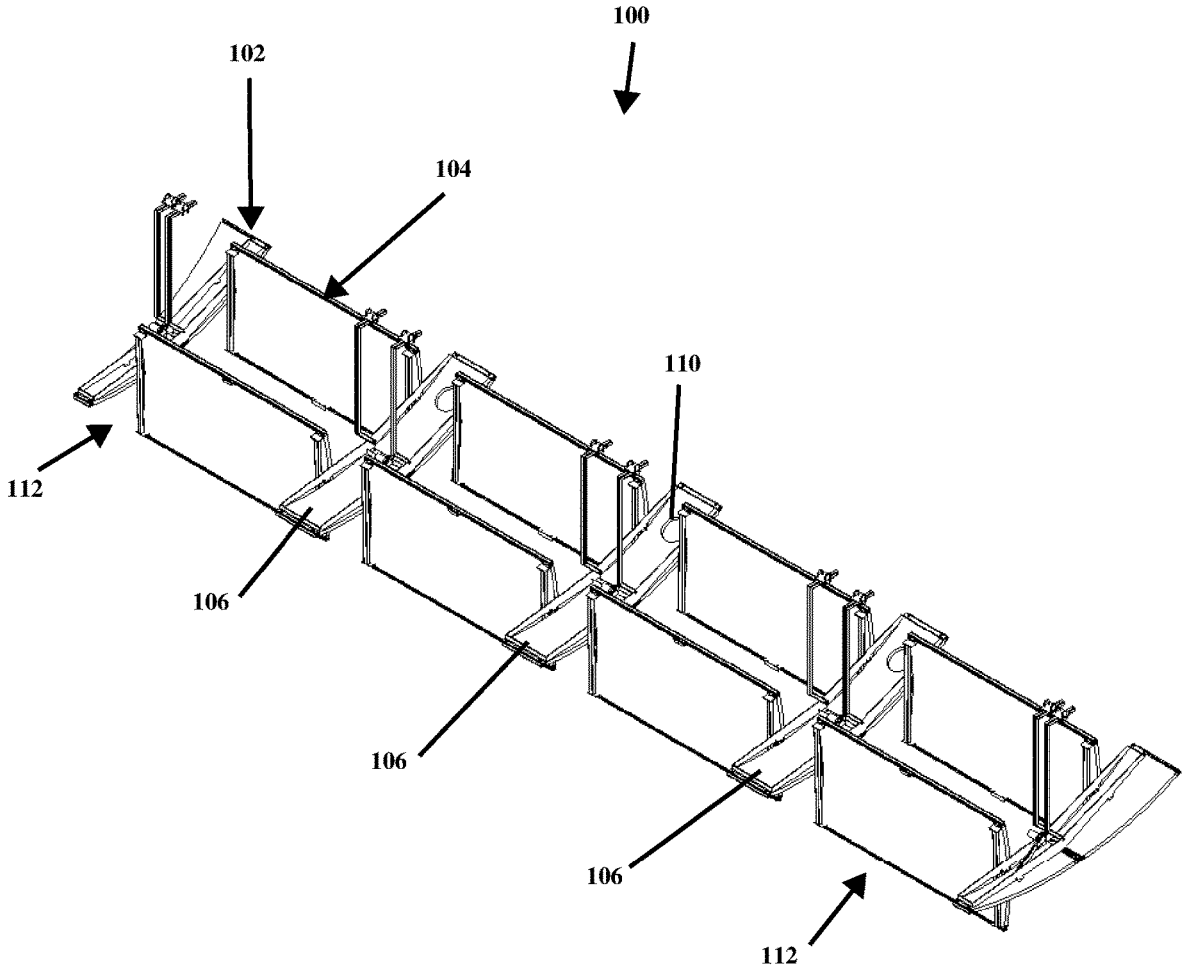
FIG. 1 is a perspective of an acoustic band shell assembly constructed according to some embodiments of the invention illustrating, among other things, the panel members in an open or disengaged condition.
Figure 2:
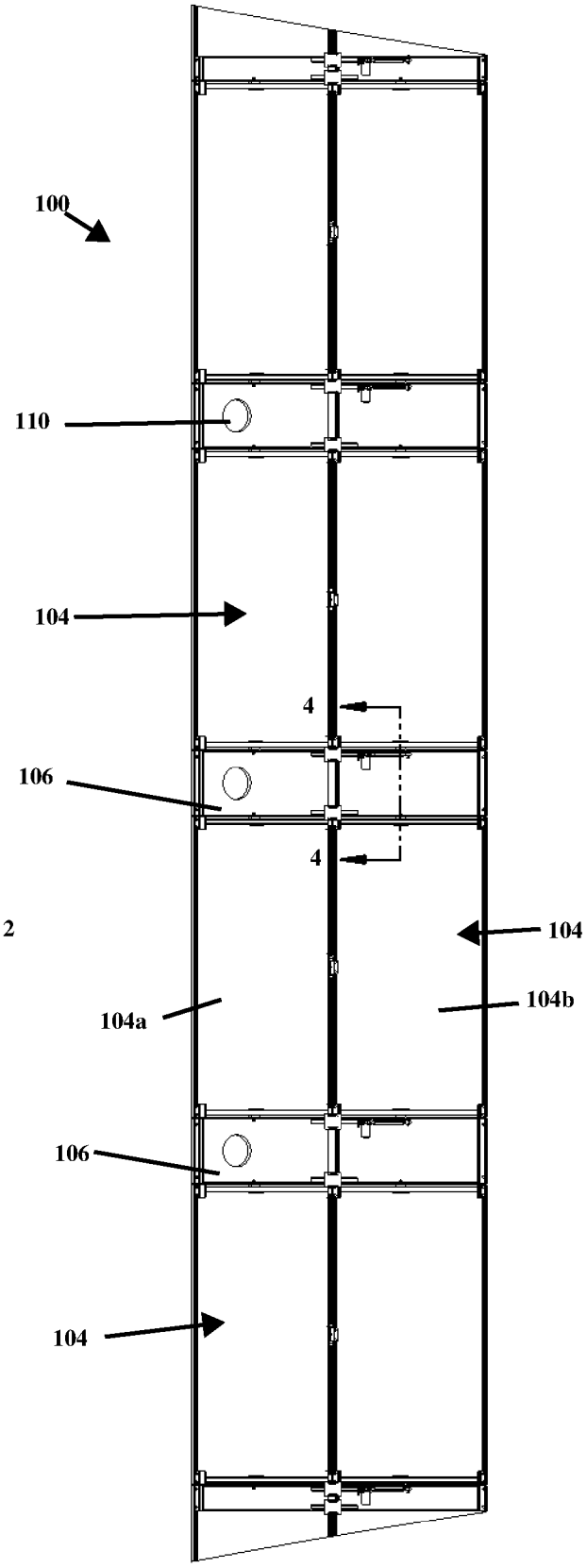
FIG. 2 is a top view of the acoustic band shell assembly of FIG. 1 illustrating, among other things, the panel members in a closed or engaged condition.
Figure 3:
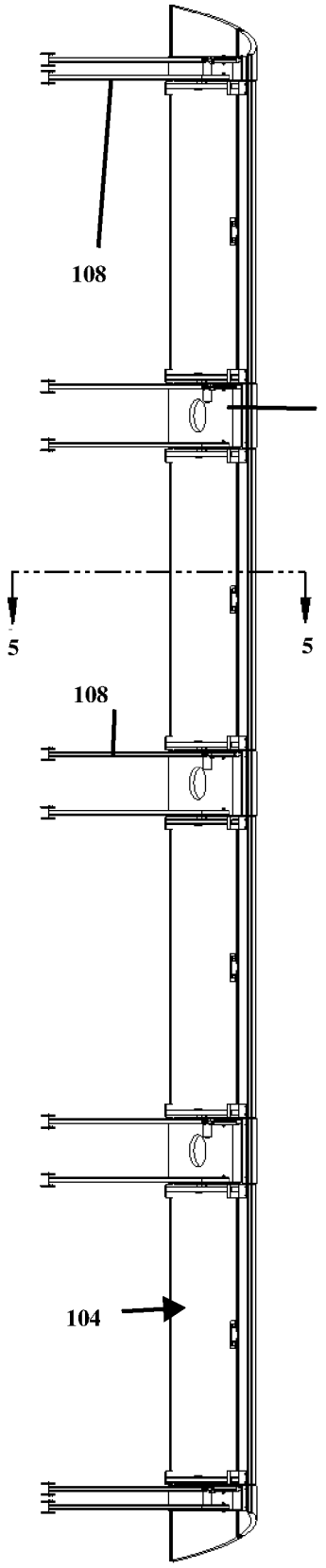
FIG. 3 is a side view of the acoustic band shell assembly of FIG. 1 with panels in the closed or engaged condition.
Figure 4:
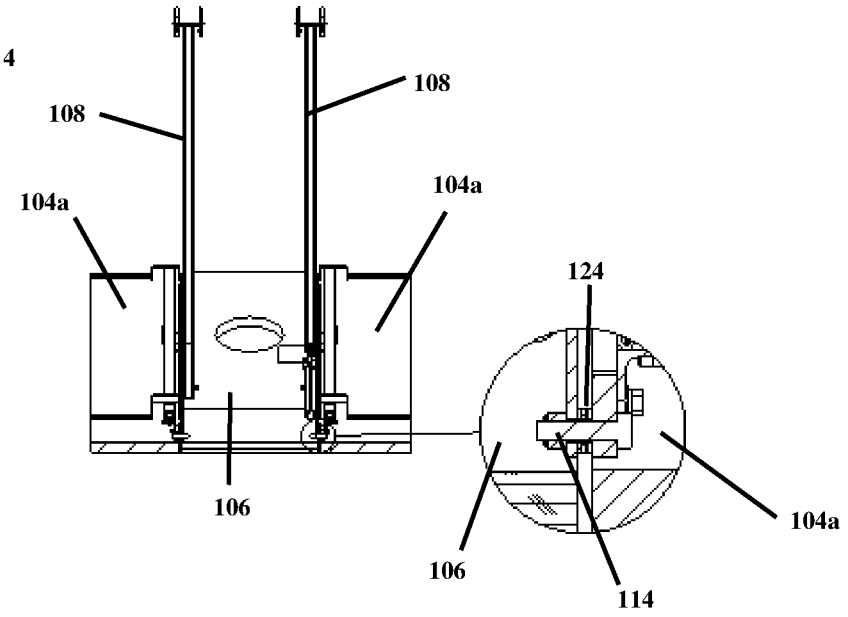
FIG. 4 is a cross sectional view and close up thereof taken along the line 4-4 of FIG. 2.
Figure 5:
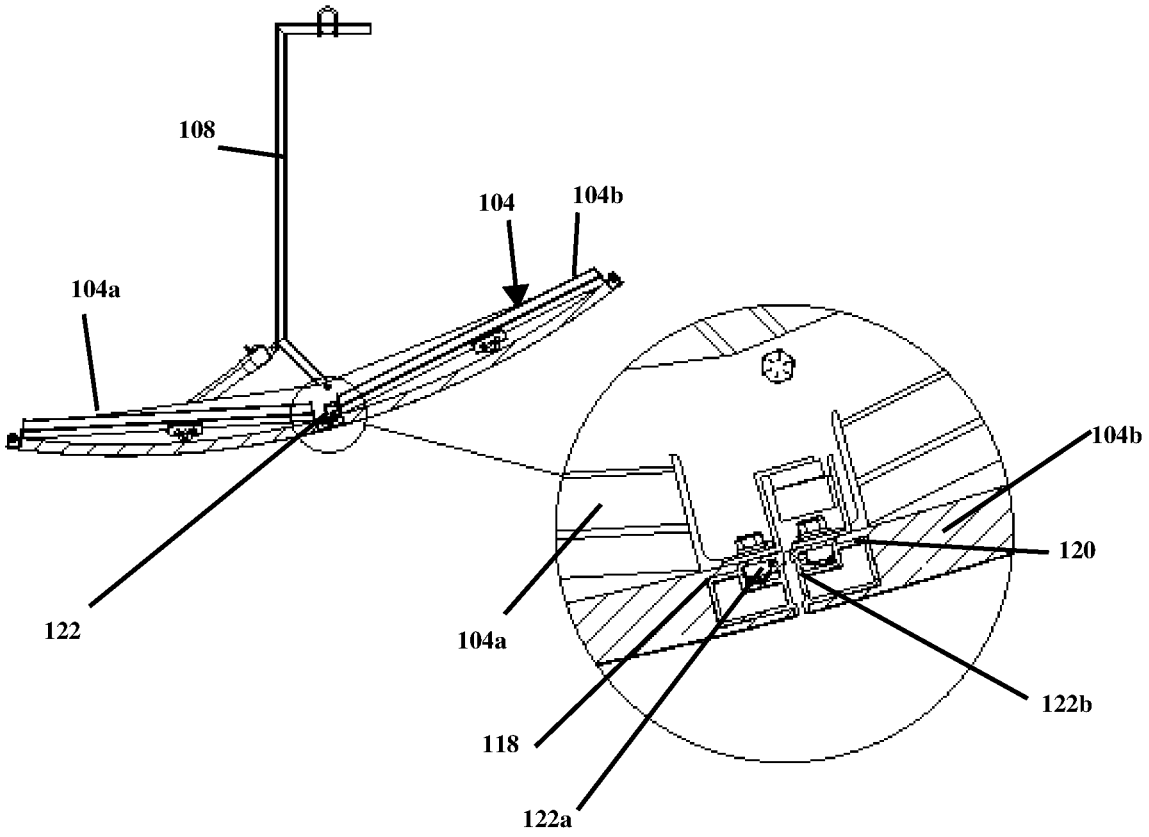
FIG. 5 is a cross sectional view and close up thereof taken along the line 5-5 of FIG. 3.
Figure 6:
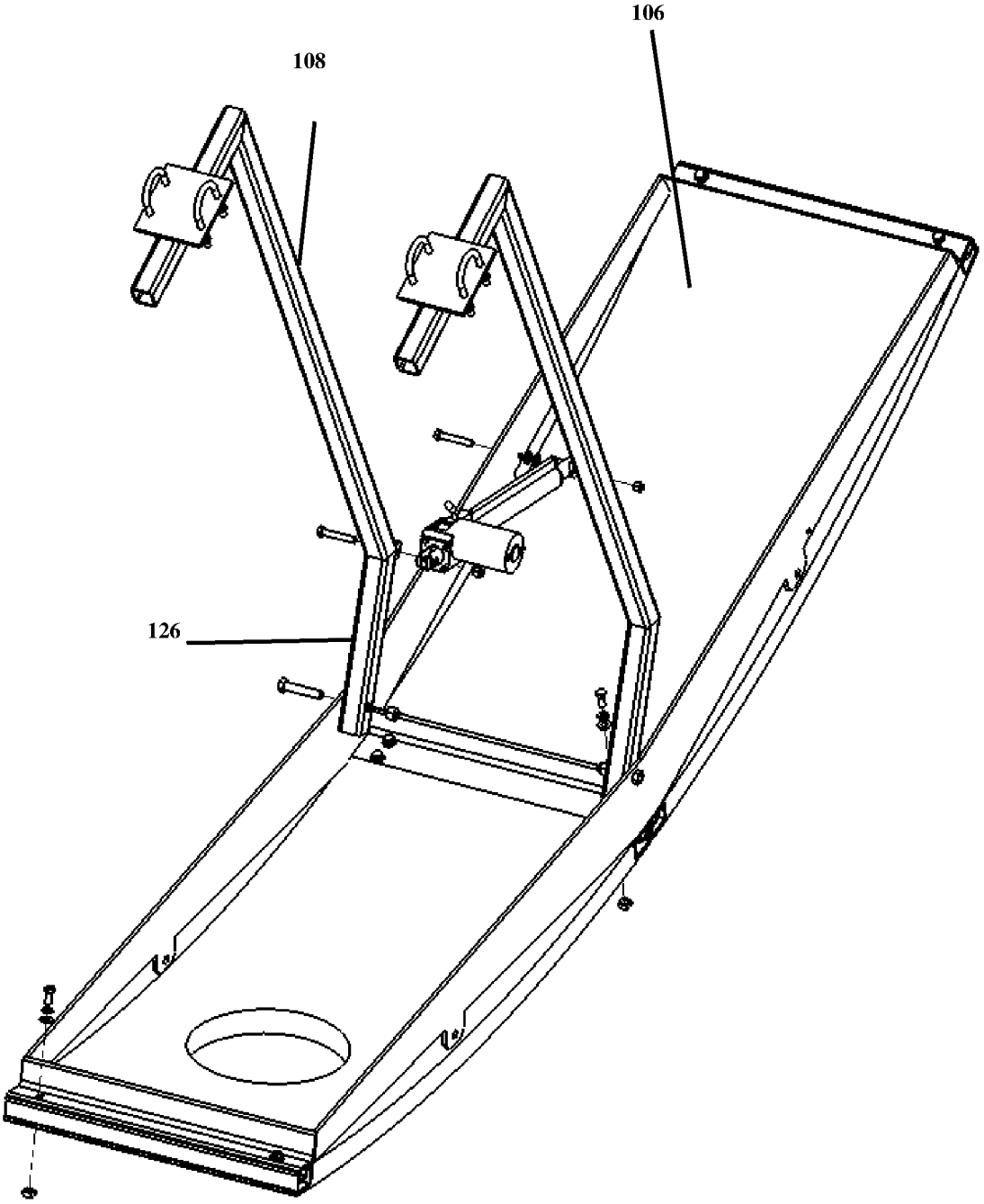
FIG. 6 is a perspective view of a portion of a beam used with the frame of the acoustic band shell assembly of FIG. 1.
Figure 7:
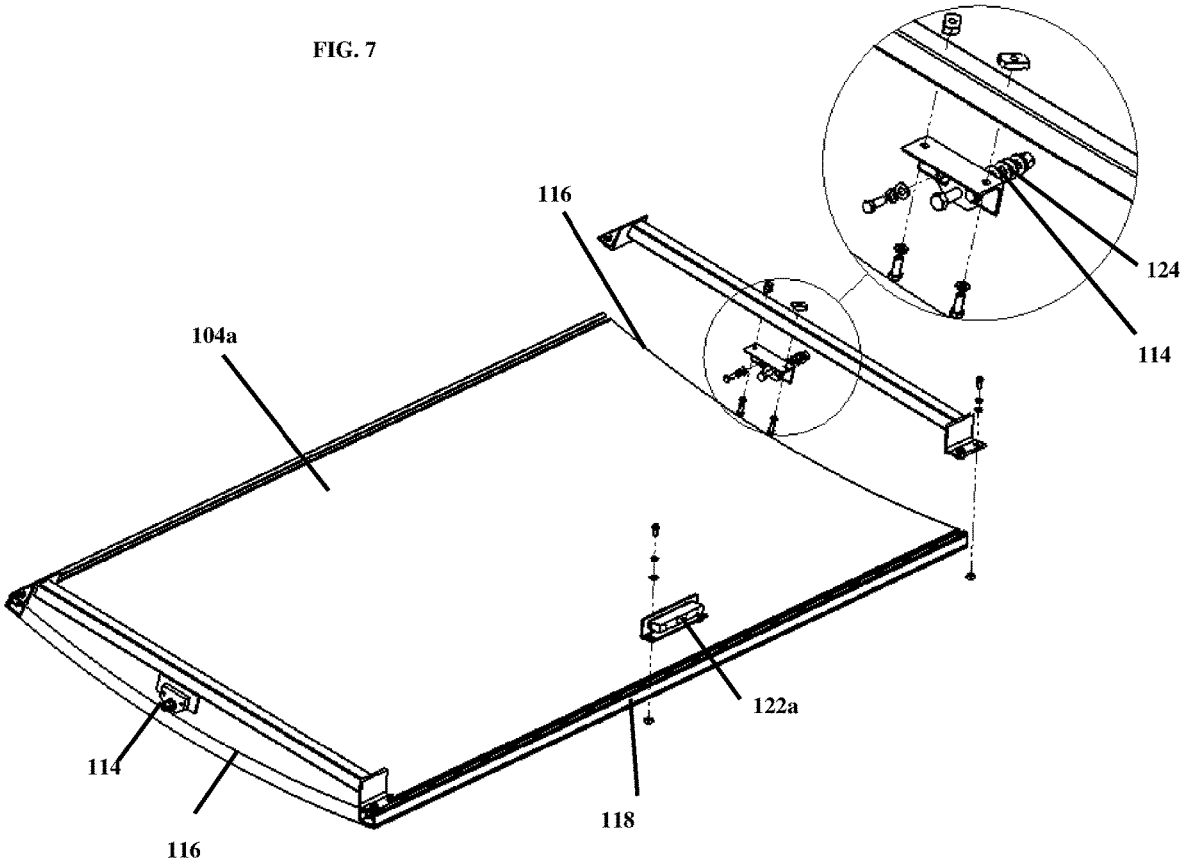
FIG. 7 is a perspective and close-up view of a first of two adjacent panels of the acoustic band shell assembly of FIG. 1.
Figure 8:
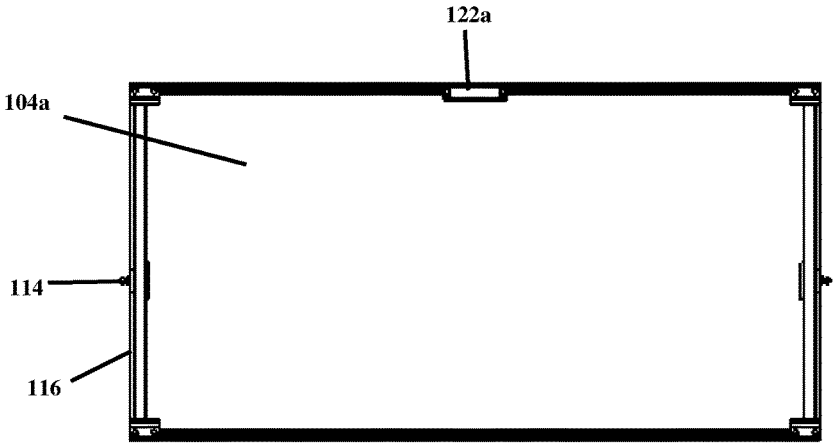
FIG. 8 is a top view of the panel shown in FIG. 7.
Figure 9:
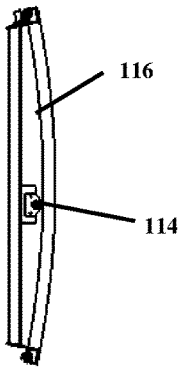
FIG. 9 is a side view of the panel shown in FIG. 7.
Figure 10:
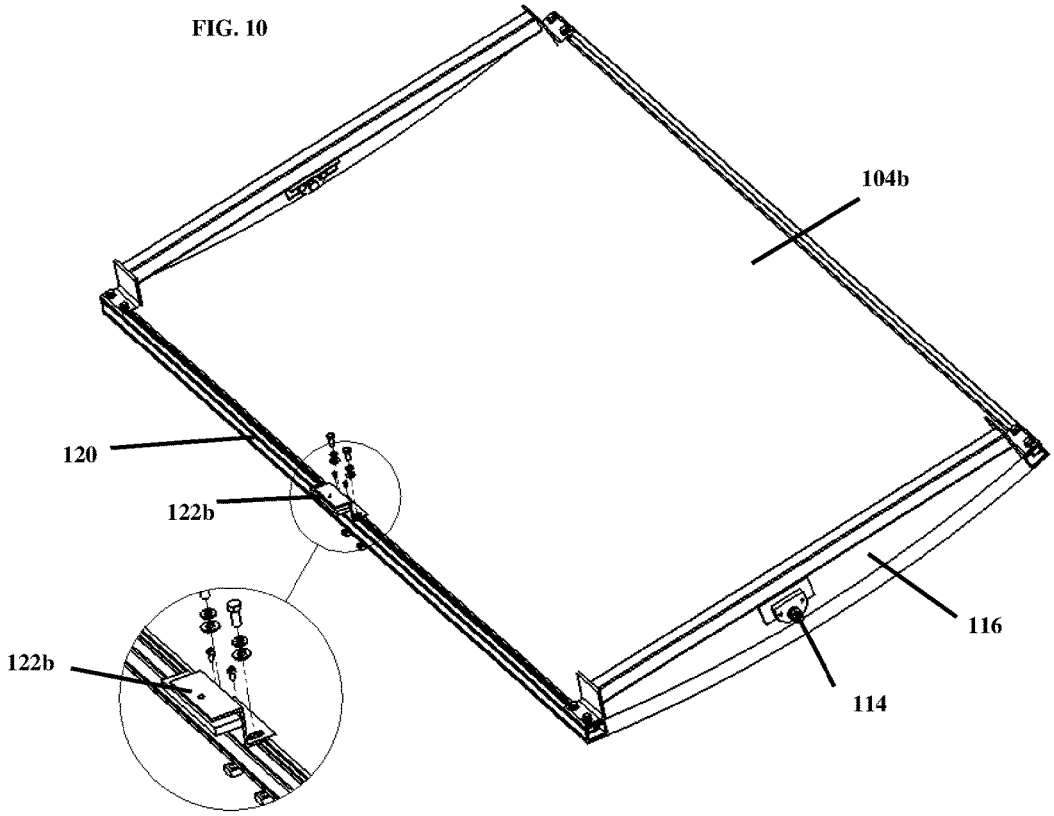
FIG. 10 is a perspective and close-up view of a second of two adjacent panels of the acoustic band shell assembly of FIG. 1.
Figure 11:
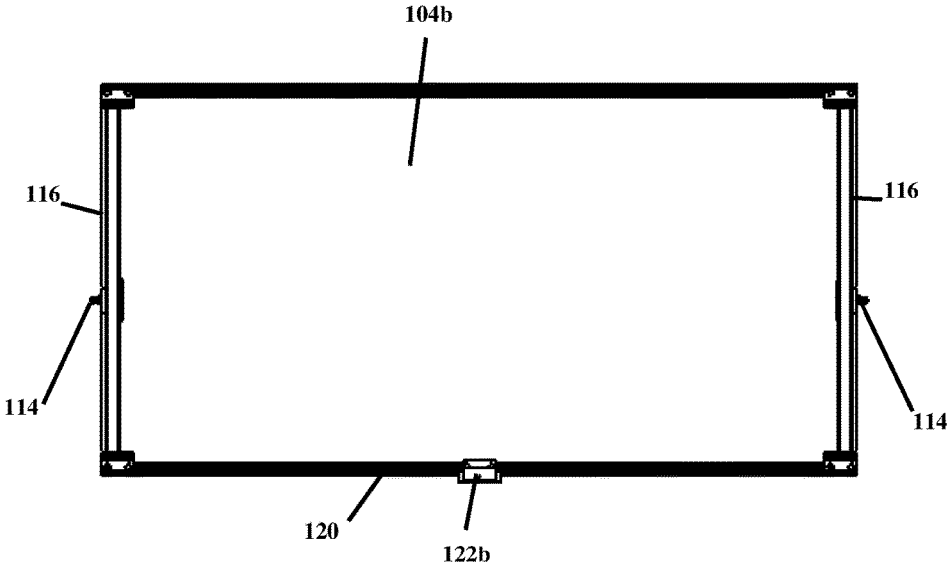
FIG. 11 is a top view of the panel shown in FIG. 10.
Figure 12:
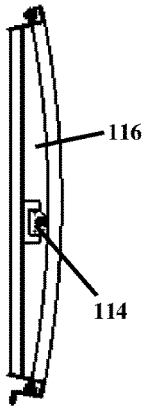
FIG. 12 is a side view of the panel shown in FIG. 10.

An embodiment of the acoustic shell assembly constructed according to the invention is illustrated in FIG. 1 and generally referred to by numeral 100. Assembly 100 includes a frame structure 102 for supporting acoustic panels 104 above a ground surface (not shown), wherein the panels 104 are mounted to alternate between an open condition as shown in FIG. 1 and a closed condition as shown in FIG. 2. In the closed condition panels 104 define, with frame 102, a generally planar wall which provides beneficial acoustic properties. Panels 104 may be generally arcuate with one side having a special acoustic or sound reflective surface disposed thereon. In the closed condition, the sound reflective surface would face the inner space formed below the ceiling and between a stage. In the open condition panels 104 no longer form a generally planar wall and panels 104 are in a generally transverse position relative to frame 102 which, among other things, would be less restrictive of fluid flow through assembly 100.

Frame 102 is further includes laterally-spaced beams 106 and support members or arms 108 for suspending frame 102 from the ground, walls, ceiling or stage rigging pipe battens (not shown). In the exemplary embodiment frame 102 is suspended from one or more stage rigging pipe battens by arms 108 being secured therein. Beams 106 may further include lighting fixtures (not shown) installed in openings 110.

Each beam 106 is spaced laterally from an adjacent beam 106 to form an open frame section 112 between each set of laterally adjacent beams 106. Each panel 104 is cooperatively supported in the open section 112 between the set of laterally-spaced beams 106. In this embodiment of assembly 100, two panels 104 (also referred to herein as 104*a* and 104*b* for ease in illustration) are mounted between each set of laterally-spaced beams 106 and within each open frame section 112. It should be understood that while panels 104 are depicted as rectangular in shape, each panel may be of other shapes as well such as circular or octagonal.

In this embodiment, each panel 104 has rods 114 protruding from opposing panel lateral sides 116 which facilitates mounting panel 104 to laterally-spaced beams 108 and enabling panels 104 to freely rotate from closed and open conditions between beams 108. Rod 114 may further include a spring 124 thereon to maintain panel 104 in position within section 112 between lateral beams 106.

Adjacent panels 104*a,b* are configured to engage one another to maintain each set of panels 104*a,b* in the closed condition. The closed condition of panels 104*a,b* may be maintained by various engagement means such as an engagement of rods 114 to restrict rotational motion of panels 104. In this embodiment, inner facing sides 118 and 120 of respective adjacent panels 104*a,b* mounted between a set of beams 106 include elements or parts which cooperate to provide an engagement mechanism 122 for forming a non-permanent engagement of adjacent panels in the closed condition.

In this embodiment, panels 104 will freely rotate into, and come to rest in, the open condition when not engaged by engagement mechanism 122 and maintained in the closed condition. In some embodiments, the rotational motion of panels 104 is driven by a force applied on the panel or a bias of the panels. In the exemplary embodiment of the invention, rods 114 are mounted on panels 104 to be in an offset position relative to the center of gravity of each panel 104, thus actuating the free rotation of the panel in a desired direction (that is, rotating in the direction of the portion of the panel on either side of rods 114 having the greater weight) by virtue of gravitational forces applied on the panel 104 when the engagement of mechanism 122 is disengaged.

The non-permanent engagement of mechanism 122 may be created by any suitable engagement device which is configured to be engaged and disengaged in response to a triggering event. In the exemplary embodiment, the engagement mechanism 122 comprises an electromagnetic engagement which includes cooperating parts on inner facing sides 118 and 120 of adjoining panels 104*a,b*, such as singular magnetic engagement members 122*a* and 122*b*, to establish an engagement of sufficient strength to hold adjacent panels 104 in the closed condition. The engagement may be formed by supplying electrical current to mechanism 122 through wiring provided along the beams 106 and panels 104, or multi-conductor cables suspended from the ceiling connected to mechanism 122.

In some embodiments a triggering event for causing the disengagement of panels 104 via the deactivation of the electromagnetic engagement formed by mechanism 122 may be the result of the electrical supply to the engagement being terminated. Upon being disengaged, the bias created by the offset rod positioning takes over and the adjacent panels 104 rotate into the open condition. The engagement of each disengaged panel 104 may be resumed by rotating the disengaged panels 104 about their respective axes until the engagement members 122*a* and 122*b* on the inner facing sides 118 and 120 contact one another. Provided that the electrical supply to the electromagnetic engagement is turned on, the engagement between the adjacent panels 104 will resume.

In use, the electromagnetic engagement of the invention may be in communication with a fire alarm system, such as a building fire alarm, rate of rise detectors or fusible links which will provide the triggering event, such as by automatically stopping the supply of electricity, including the supply of electricity to the electromagnetic engagement as is routine upon activating the sprinkler system and roof hatches. The disengaged panels 104 of this embodiment then rotate into the open condition, which advantageously enables the sprinkler system to direct water through the transversely positioned panels 104 of the acoustic shell ceiling assembly 100.

Figure 13:
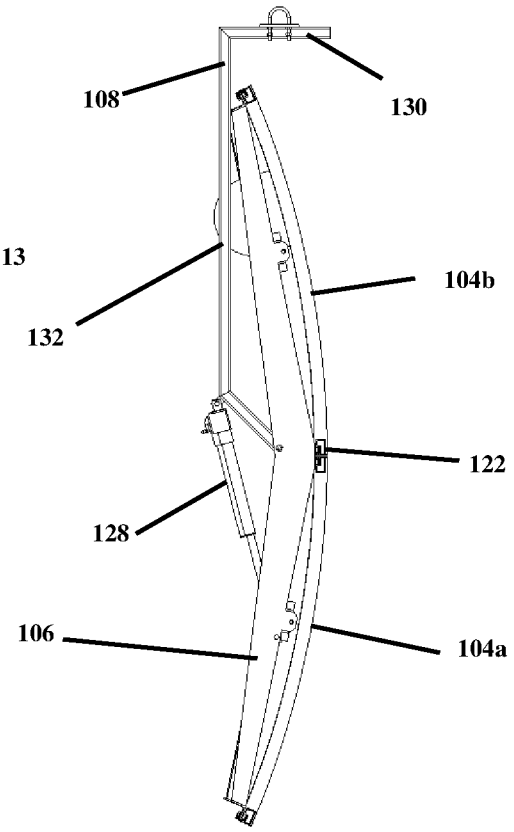
FIG. 13 is a side view of a portion of acoustic band shell assembly of FIG. 1 moved into a parallel or storage condition.
Figure 14:
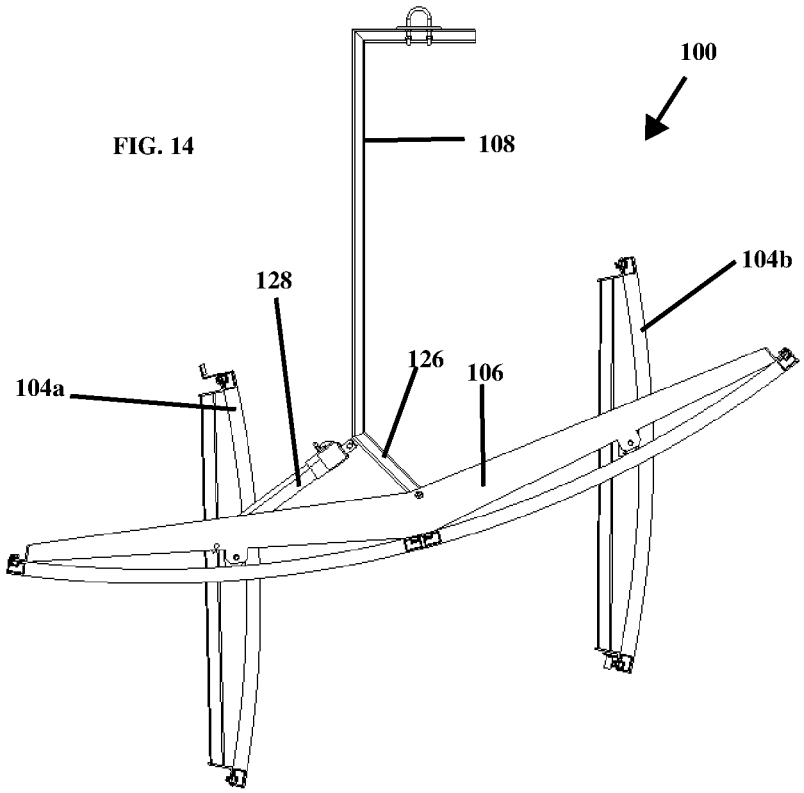
FIG. 14 is a side view of a portion of acoustic band shell assembly of FIG. 1 moved into a perpendicular or operative condition.

In the exemplary embodiment each beam 106 of frame 102 is hingedly mounted to arms 108 by pivoting arms 126 and 128 which enables beams 106, including the engaged adjacent panels 104, to be pivoted from a generally perpendicular position relative to arms 108 as shown in FIG. 14 to a generally parallel position relative to arms 108 as shown in FIG. 13. Arms 108 may be suitable configured, such as shown, with a hook or lateral portion 130 and parallel portion 132, for accommodating the assembly in the parallel position as shown in FIG. 13. Beams 106 are engaged with arms 108 to maintain this position to, among other things place the acoustic ceiling in a condition which facilitates storage of assembly 100 when not in use. An actuator device (not shown), which may be motorized, and arms 126 and/or 128 may include hydraulic devices, to facilitate moving the beams between the parallel and perpendicular positions.

The acoustic shells of the invention can have a variety of different forms and features. It should be understood that the panels and/or beams and other support members may be constructed of a variety of materials. For example, the panels and beams can be formed of materials, such as wood, plaster, metal, gypsum, and fiberglass, and include a coating. Further, the panels and beams can be in various shapes, such as rectilinear shapes as in a shelled room, or curved shapes as in a shelled semi-dome. Moreover, the assembly of the invention can be formed as either permanent fixtures or fully removable parts of the venues in which the invention is used.

While exemplary apparatus, systems and methods of the invention have been described herein, it should also be understood that the foregoing is only illustrative of a few particular embodiments with exemplary and/or preferred features, as well as principles of the invention, and that various modifications can be made by those skilled in the art without departing from the scope and spirit of the invention. Therefore, the described embodiments should not be considered as limiting of the scope of the invention in any way. Accordingly, the invention embraces alternatives, modifications and variations which fall within the spirit and scope of the invention as set forth herein, in the claims and any equivalents thereto.

The invention claimed is:

1. An acoustic band shell assembly comprising:

a frame;

a first panel and a second panel, each of the first panel and the second panel defining opposing panel sides, each of the first panel and the second panel being mounted to the frame adjacent the opposing panel sides and configured to enable rotational motion of each of the first panel and the second panel about an axis defined between the respective opposing panel sides whereby the first panel and the second panel are independently enabled to move from and between an open condition and a closed condition and remain mounted to the frame, the first panel including a first side and the second panel including a second side, the first panel and the second panel forming a generally planar wall with the first side and second side being adjacent to one another responsive to the first panel and the second panel being engaged in the closed condition, wherein the first panel and the second panel are biased for independent rotational motion from the closed condition into the open condition responsive to being disengaged;

a first engagement member mounted on the first side; and a second engagement member mounted on the second side, the first engagement member and the second engagement member being positioned respectively on the first side and the second side to contact one another responsive to the first panel and the second panel being in the closed condition;

wherein the first engagement member and the second engagement member are configured to cooperate with one another to form a non-permanent engagement, the non-permanent engagement maintaining the first panel and the second panel in the closed condition, and wherein the first engagement member and the second engagement member permit the first panel and the second panel are enabled to freely and independently move solely through gravitational force and without powered assistance from the closed condition to the open condition responsive to the non-permanent engagement being disengaged subsequent to forming the non-permanent engagement.

2. The acoustic band shell assembly of claim 1, wherein the frame further includes at least one set of lateral beams.

3. The acoustic band shell assembly of claim 2, wherein the first panel and the second panel are mounted to the at least one set of lateral beams.

4. The acoustic band shell assembly of claim 3, wherein the first panel and the second panel are mounted to the at least one set of lateral beams by a rod extending from opposing lateral sides of the first panel and the second panel.

5. The acoustic band shell assembly of claim 4, wherein the rod is positioned to be offset from a center of gravity of the first panel and the second panel to define a first panel portion and a second panel portion for each of the first panel and the second panel, the first panel portion being adjacent to the rod and the first panel portion having greater weight as compared with the second panel portion.

6. The acoustic band shell assembly of claim 1, wherein the non-permanent engagement comprises an electromagnetic engagement.

7. An acoustic band shell assembly comprising:

first and second beam members, the first and second beam members being laterally spaced from one another to define a space between the first and second beam members;

first and second panels mounted adjacent one another extending transversely within the space defined between the first and second beam members whereby the first and second panels define opposing inner facing sides, each of the first and second panels being mounted to the first and second beam members for independent rotational motion of the first and second panels about a transverse axis defined between the first and second beam members, the first and second panels being enabled for movement from and between an open condition and a closed condition, the first and second panels each including cooperating engagement members mounted thereon, wherein a first cooperating engagement member is mounted on the inner facing side of a first panel of the first and second panels and a second cooperating member is mounted on the inner facing side of a second panel of the first and second panels, the cooperating engagement members being configured to form an engagement, the engagement maintaining the first and second panels in a generally planar configuration in the closed condition, and wherein the first and second panels are biased to freely and independently move solely through gravitational force and without powered assistance from the closed condition into the open condition responsive to the cooperating engagement members mounted on the inner facing sides of the first and second panels being disengaged subsequent to forming the engagement, the first and second panels being in a non-planar configuration in the open condition.

8. The acoustic band shell assembly of claim 7, further comprising a support arm connected to the first and second beam members configured to suspend the acoustic band shell assembly.

9. The acoustic band shell assembly of claim 7, wherein the first and second beam members are arcuate.

10. The acoustic band shell assembly of claim 7, wherein the first and second panels are rectangular shaped.

11. The acoustic band shell assembly of claim 7, wherein the first and second panels are arcuate.

12. The acoustic band shell assembly of claim 7, wherein the first and second panels are mounted to the first and second beam members by a rod extending from opposing lateral sides of each panel of the first and second panels.

13. The acoustic band shell assembly of claim 12, wherein the rod is positioned to be offset from a center of gravity of each panel of the first and second panels to define a first panel portion of each panel of the first and second panels, the first panel portion being adjacent to the rod and having greater weight as compared with a second panel portion.

14. The acoustic band shell assembly of claim 7, wherein the cooperating engagement members are in communication with electrical current to form an electromagnetic engagement.

* * * * *